US009074569B2

(12) United States Patent
Nieda

(10) Patent No.: US 9,074,569 B2
(45) Date of Patent: Jul. 7, 2015

(54) RECOIL STARTER

(71) Applicant: Seiichi Nieda, Tokyo (JP)

(72) Inventor: Seiichi Nieda, Tokyo (JP)

(73) Assignee: STARTING INDUSTRIAL CO., LTD., Tokyo (JP)

( * ) Notice: Subject to any disclaimer, the term of this patent is extended or adjusted under 35 U.S.C. 154(b) by 189 days.

(21) Appl. No.: 13/750,074

(22) Filed: Jan. 25, 2013

(65) Prior Publication Data

US 2013/0186363 A1 Jul. 25, 2013

(30) Foreign Application Priority Data

Jan. 25, 2012 (JP) ..... 2012-012997

(51) Int. Cl.
*F02N 1/00* (2006.01)
*F02N 1/02* (2006.01)
*F02N 3/02* (2006.01)

(52) U.S. Cl.
CPC ... *F02N 1/02* (2013.01); *F02N 3/02* (2013.01)

(58) Field of Classification Search
CPC ..... F02N 3/02; F02N 5/02; F02N 15/027; F16F 1/10; F16F 15/1213; F16F 15/1216; F16F 1/06
USPC ..... 123/185.2, 185.3, 185.4, 185.6, 185.13
See application file for complete search history.

(56) References Cited

U.S. PATENT DOCUMENTS

| | | | | |
|---|---|---|---|---|
| 5,826,555 | A * | 10/1998 | Aronsson et al. | 123/185.3 |
| 7,028,658 | B2 * | 4/2006 | Kruse et al. | 123/185.3 |
| 7,191,752 | B2 * | 3/2007 | Schriever et al. | 123/185.3 |
| 8,534,254 | B2 * | 9/2013 | Ziegs et al. | 123/185.3 |
| 2005/0252477 | A1 * | 11/2005 | Schriever et al. | 123/185.14 |
| 2006/0070596 | A1 * | 4/2006 | Horikoshi | 123/185.3 |
| 2010/0126455 | A1 * | 5/2010 | Ziegs et al. | 123/185.3 |
| 2013/0186363 | A1 * | 7/2013 | Nieda, Seiichi | 123/185.3 |

FOREIGN PATENT DOCUMENTS

| | | | |
|---|---|---|---|
| JP | 2003-269300 | | 9/2003 |
| JP | 2003269300 | * | 9/2003 |
| JP | 2008-75594 | | 4/2008 |

* cited by examiner

*Primary Examiner* — Hai Huynh
*Assistant Examiner* — Raza Najmuddin
(74) *Attorney, Agent, or Firm* — Nixon & Vanderhye P.C.

(57) ABSTRACT

One embodiment provides a recoil starter for starting an engine. The recoil starter includes: a starter case having a storage portion; a rope reel rotatably accommodated in the storage portion, a recoil rope being wound on the rope reel; a recoil spring interposed between the rope reel and the starter case within the storage portion; a cam portion rotatable concentrically with the rope reel and engageable with the engine; and a dust cover provided on an opening of the storage portion to cover the rope reel. The rope reel has concentric circular uneven portions formed on a surface thereof facing the engine, and the dust cover also has concentric circular uneven portions. Therefore, the circular uneven portions of the rope reel and the circular uneven portions of the dust cover fit with each other to provide a nest structure.

3 Claims, 4 Drawing Sheets

RECOIL STARTER

CROSS-REFERENCE TO RELATED APPLICATION(S)

This application claims priority/priorities from Japanese Patent Application No. 2012-012997 filed on Jan. 25, 2012, the entire contents of which are herein incorporated by reference.

FIELD

The present invention relates to a recoil starter which is used to start an engine by pulling a recoil rope.

BACKGROUND

Such recoil starter includes a rope reel on which the recoil rope wound. By pulling the recoil rope, the rope reel is rotated, and the rotational power thereof is transmitted from a cam portion toward the engine.

Such recoil starter is often used under an operation environment where much dust exists. Therefore, such dust is easy to float into a starter case from its opening and stick to the recoil rope or a recoil spring used for rewinding the recoil rope. Since the recoil spring rotates in an operational direction or in a rewinding direction whenever the engine starting operation is performed, dust stuck to the surface thereof acts like a file or a sand paper, whereby the recoil rope may be damaged or the returning property of the recoil spring may be deteriorated. Thus, the poor operation of the recoil starter may be caused.

For example, JP-2008-075594-A and JP-2003-269300-A propose a recoil starter which includes a dust cover provided on a starter case.

However, since most of dust is fine, the dust cover in JP-2008-075594-A or JP-2003-269300-A may not provide a sufficient dustproof effect.

SUMMARY

A first aspect of the present invention provides a recoil starter for starting an engine, including: a starter case having a storage portion; a rope reel provided inside the starter case; a rope reel rotatably mounted on the reel support shaft within the storage portion, a recoil rope being wound on the rope reel; a recoil spring interposed between the rope reel and the starter case within the storage portion, the recoil spring urging the recoil reel in a direction of rewinding the recoil rope; a cam portion rotatable concentrically with the rope reel and engageable with the engine, a rotational power of the rope reel being transmitted to the engine through the cam portion; and a dust cover provided on an opening of the storage portion to cover the rope reel, wherein the rope reel has concentric circular uneven portions formed on a surface thereof facing the engine, and wherein the dust cover also has concentric circular uneven portions so that the circular uneven portions of the rope reel and the circular uneven portions of the dust cover fit with each other to provide a nest structure.

A second aspect of the present invention provides, based on the first aspect, the recoil starter, wherein the rope reel has a tubular portion projected from a central portion thereof toward the engine, and wherein the cam portion is formed at a leading end of the tubular portion.

A third aspect of the present invention provides, based on the first aspect, the recoil starter, further including: a cam plate provided between the rope reel and the engine, the cam plate having a tubular portion projected from a central portion thereof toward the engine, the cam portion being formed at a leading end of the tubular portion; and a damper spring provided between the rope reel and the cam plate to connect them together.

A forth aspect of the present invention provides, based on the first aspect, the recoil starter, wherein the dust cover includes an outside storage section formed to cover the cam portion.

A fifth aspect of the present invention provides, based on the first aspect, the recoil starter, wherein the storage portion includes an inside storage section defining the storage portion and an outside storage section formed to cover the cam portion.

According to the first aspect, for example, since the dust cover is provided on the engine side of the rope reel for covering the opening of the storage portion and the concentrically-formed circular uneven portions of the dust cover are formed to provide a nest structure with the concentrically-formed circular uneven portions of the rope reel, even if dust produced during operation attempts to enter the storage portion from between the tubular portion of the rope reel and the central hole of the dust cover, the dust must pass through the clearance between the circular uneven portions before reaching the storage portion. Since the clearance between the circular uneven portions of the rope reel and the circular uneven portions of the dust cover has the zigzag arrangement along the radial direction, it corresponds to an imaginarily very long straight line. That is, in order for the dust having entered from the central hole of the dust cover 15 to reach the outer edge of the rope reel through the clearance between the circular uneven portions, the dust must advance beyond the uneven portions for a long distance, which takes a lot of time. Also, when a portion of the dust clogs halfway with the clearance, the clogging of the dust spreads from there, which makes it harder for the dust to further advance. This can effectively prevent the dust from entering inside the starter case 1 and sticking to the recoil rope 2 and the recoil spring 9. Thus, the poor operation or malfunction of the recoil starter due to the sticking of dust to these parts can be surely prevented.

According to the second aspect, for example, since the cam portion is formed in the leading end of the tubular portion projected from the rope reel toward the engine, the cam portion need not to be provided separately from the rope reel. This can simplify the structure of the recoil starter and thus can reduce the cost thereof.

According to the third aspect, for example, since the cam portion is formed on the cam plate provided between the rope reel and the engine, and the rope reel and the cam plate are connected together through the damper spring, the rotational power of the rope reel can transmitted to the cam portion for starting the engine at a breath after the sufficient rotational power has been stored into the damper spring. Therefore, the engine can be started surely.

According to the fourth aspect, for example, since the outside storage section for covering the cam portion and the dust cover are formed as an integral body, when assembling the recoil spring, the rope reel and the like, the outside storage section does not interfere with such assembling operation, thereby facilitating the assembling operation.

DETAILED DESCRIPTION

Figure 1:
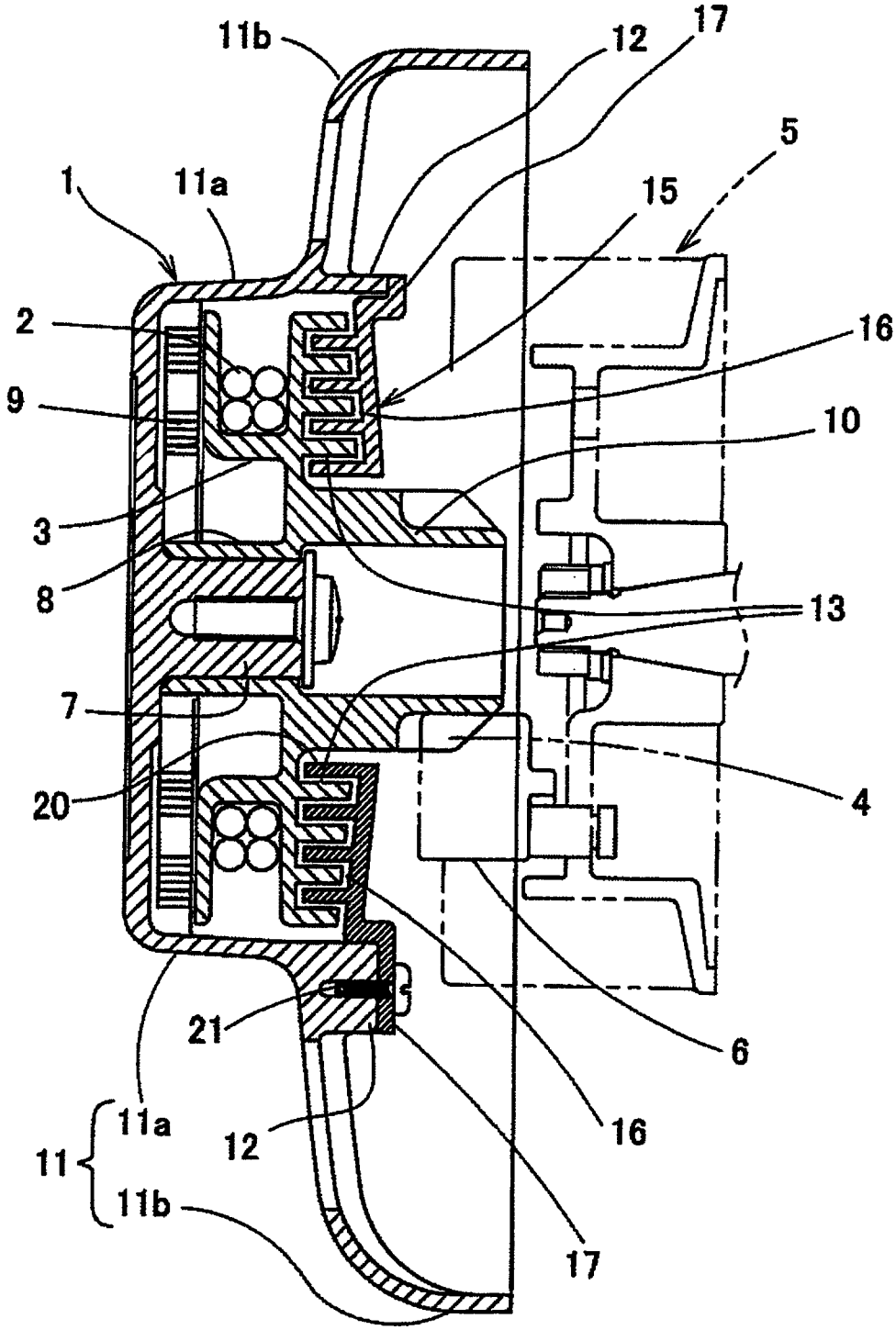
FIG. 1 cross-sectionally illustrates a recoil starter according to an embodiment.
Figure 2:
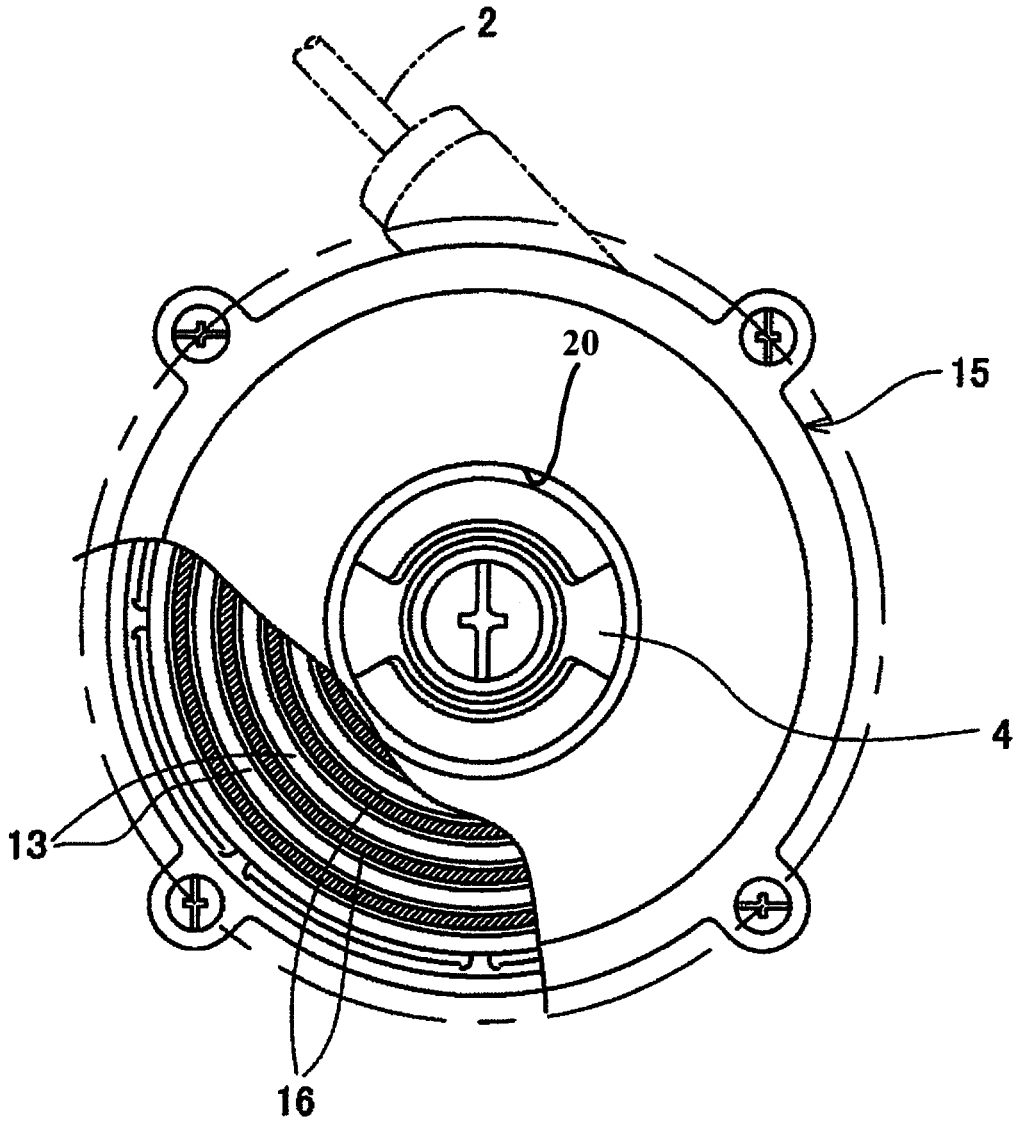
FIG. 2 illustrates the recoil starter from a front in a partially-cut-out manner.

FIG. 1 cross-sectionally illustrates a recoil starter according to an embodiment, and FIG. 2 illustrates a front view of the recoil starter in a partially-cut-out manner.

The recoil starter includes a starter case 1, a rope reel 3 rotatably accommodated within the starter case 1 and a cam portion 4 rotatable concentrically with the rope reel 3. The starter case 1 has a reel support shaft 7 inwardly and integrally projects therefrom, and the rope reel 3 has a baring boss portion 8 formed in a central portion thereof. Thus, the rope reel 3 is rotatably supported on the reel support shaft 7 at the bearing boss portion 8.

A recoil rope 2 is wound on the rope reel 3. One end of the recoil rope 2 is pulled out outside the starter case 1, and the other end is fixed to the rope reel 3, so that the rope reel 3 can be driven or rotated by pulling the end portion of the recoil rope 2.

According to the above-described structure, the rotational power of the thus-rotated rope reel 3 is transmitted to the cam portion 4, and further transmitted to a pulley 5 mounted on a crank shaft (not shown) of an engine through an engagement between the cam portion 4 and a ratchet portion 6 provided on the pulley 5, whereby an engine can be started.

A recoil spring 9 for rewinding the pulled-out recoil rope 2 onto the rope reel 3 is interposed between one side surface of the rope reel 3 and the inner wall surface of the starter case 1 which face with each other. An inner-periphery-side end of the recoil spring 9 is fixed to the starter case 1, while an outer-periphery-side end thereof is fixed to the rope reel 3. When the recoil rope 2 is pulled to rotate the rope reel 3, rotational power is stored in the recoil spring 9. And, when the pulling force of the recoil rope 2 is released, the rope reel 2 is rotated in the reverse direction due to the rotational power stored in the recoil spring 9 to thereby rewind the recoil rope 2 onto the rope reel 3.

The rope reel 3 also has a tubular portion 10 formed on the opposite side to the bearing boss portion 8, that is, to project toward the engine. The cam portion 4 is formed in the tubular portion 10. The cam portion 4 is engageable with the ratchet portion 6 provided on the pulley 5 mounted on the crank shaft of the engine.

For example, when the recoil rope 2 is pulled strongly to rotate the rope reel 3 and the rotational power of the rope reel 3 exceeds the start load of the engine, this rotational power is transmitted to the cam portion 4 and further to the pulley 5 through the ratchet portion 6, thereby starting the engine.

After the engine starts, the ratchet portion 6 swings outwardly due to the centrifugal force to thereby be disengaged from the cam portion 4. Therefore, the rotation of the engine is no longer transmitted toward the cam portion 4. And, by releasing the recoil rope 2, the rope reel 3 is rotated in the reverse direction due to the rotational power stored in the recoil spring 9 to rewind the recoil rope 2.

A storage portion 11 of the starter case 1 includes a small-diameter inside storage section 11*a*, a large-diameter outside storage section 11*b* and an extension portion 12. The inside storage section 11*a* accommodates the recoil spring 9 and the rope reel 3, and the outside storage section 11*b* accommodates the ratchet portion 6 and an end portion of the pulley 5. The extension portion 12 extends from the peripheral end portion of the inside storage section 11*a* into the outside storage section 11*b*. And, the rope reel 3 includes circular uneven portions 13 concentrically formed on the side surface thereof facing the engine.

The recoil starter further includes a dust cover 15 provided on the opening of the inside storage section 11*a* of the starter case 1 to cover the rope reel 3. The dust cover 15 is formed into a donut shape. The dust cover includes a central hole 20 in the central portion thereof, circular uneven portions 16 in the periphery of the central hole 20 and an engaging step portion 17 in the outer peripheral edge thereof. The circular uneven portions 16 are formed to be similar to the circular uneven portions 13.

To mount the dust cover 15, the central hole 20 of the dust cover 15 is fitted with the outside of the tubular portion 10 of the rope reel 3. Simultaneously, the circular uneven portions 16 are fitted with the circular uneven portions 13 of the rope reel 3, and the engaging step portion 17 is engaged with the end of the extension portion 12 of the inside storage section 11 a and then fixed thereto using a screw 21 with a given clearance. Thus, the rope reel 3 and recoil spring 9 are accommodated into the storage portion 11. Here, the circular uneven portions 16 of the dust cover 15 and the circular uneven portions 13 of the rope reel 3 have a nest structure fitting with each other.

According to the above structure, since the front side of the starter case 1 is closed, dust exiting outside it is prevented from entering it from its front side. Also, since the peripheral end portion of the dust cover 15 sticks closely to the outer peripheral side of the inside storage section 11*a*, similarly, dust is prevented from entering the inside storage section 11*a* from its outer peripheral side.

On the other hand, since a clearance is formed between the central hole 20 of the dust cover 15 and the tubular portion 10 of the rope reel 3, dust produced during operation might enter the inside storage section 11*a* from this clearance. However, the dust having passed the clearance between the central hole 20 and the tubular portion 10 must also pass through a clearance between the inner surface of the dust cover 15 and the side surface of the rope reel 3. Since the concentric circular uneven portions 16 and the concentric circular uneven portions 13 are formed on the dust cover 15 and the rope reel 3 are formed, respectively, to provide a nest structure at that portion, the dust must pass through the clearance having the zigzag arrangement along the radial direction defined between the circular uneven portions 13 and 16. It corresponds to an imaginarily very long straight line. That is, in order for dust having entered from the central hole 20 of the dust cover 15 to reach the outer edge of the rope reel 3 through the clearance between the circular uneven portions 13 and 16, the dust must go beyond the uneven portions for a long distance, which takes a lot of time. Also, when the middle portion of the clearance is clogged with a portion of the dust, such clog widens from this portion, which makes it more difficult for the dust to advance further. This can effectively prevent dust from entering inside the starter case 1 and sticking to the recoil rope 2 and the recoil spring 9. Thus, the poor operation or malfunction of the recoil starter due to the sticking of dust to these parts can be surely prevented.

Also, since the cam portion 4 is formed in the leading end of the tubular portion 10 projected from the central portion of the rope reel 3 toward the engine, the cam portion 4 need not to be formed separately from the rope reel 3. This can simplify the structure of the recoil starter and thus can reduce the cost thereof.

Figure 3:
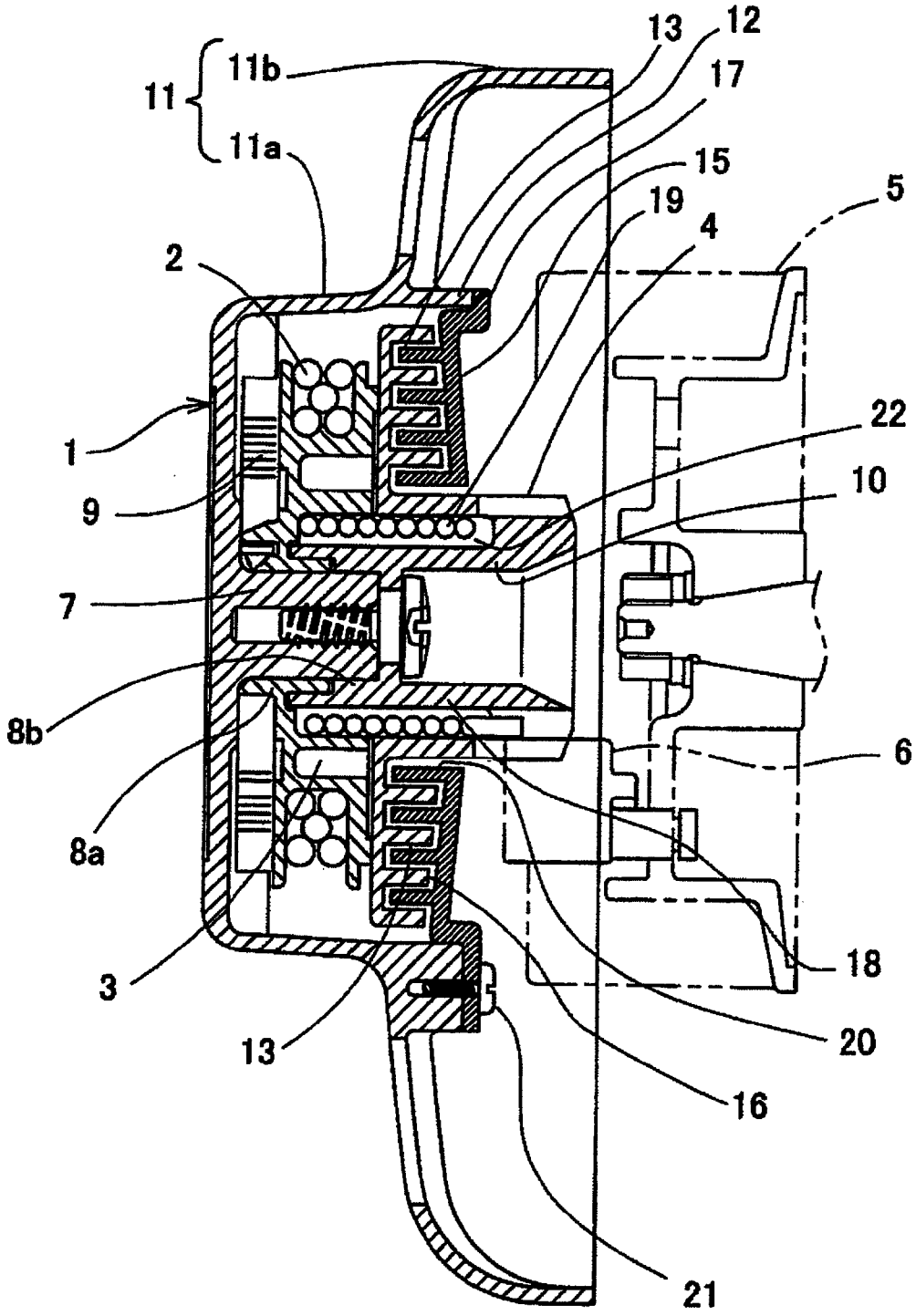
FIG. 3 cross-sectionally illustrates a recoil starter according to another embodiment.

The invention is not limited to the above-mentioned embodiment. For example, as shown in FIG. 3, there may be provided a recoil starter having a rope reel 3 and a cam plate 18 as separate members. A cam portion 4 is provided on the cam plate 18, and bearing boss portions 8*a*, 8*b* are respectively formed in the central portions of the rope reel 3 and the cam plate 18. A damper spring 19 is accommodated in a circular storage portion 22 formed on the outer periphery side of the bearing boss portions 8*a*, 8*b*. One end of the damper spring 19 is secured to the rope reel 3, and the other end is secured to the cam plate 18. In this structure, the rope reel 3 and cam plate 18 are respectively disposed to be rotatable about a reel support shaft 7, while they are connected together through the damper spring 19.

For starting the engine, for example, the recoil rope 2 is pulled strongly to rotate the rope reel 3. Meanwhile, the rotational power is stored into the damper spring 19. When the rotational power of the rope reel 3 exceeds the start load of the engine, the rotational power of the rope reel 3 and the rotational power stored into the damper spring 19 are released toward the cam plate 18 including the cam portion 4 and is further transmitted to the pulley 5 through the ratchet portion 6, whereby the crank shaft of the engine can be rotated at a breath.

After the engine starts and the crank shaft starts rotation, the ratchet portion 6 swings outwardly due to the centrifugal force to thereby be disengaged from the cam portion 4, whereby the rotation of the engine is not transmitted toward the cam portion 4. After the engine starts, by releasing the recoil rope 2, the rope reel 3 is rotated reversely due to the rotational power stored in the recoil spring 9 to rewind the recoil rope 2.

In this embodiment, the cam plate 18 includes the concentric circular uneven portions 13 at the side surface thereof facing the engine. And, a dust cover 15 is provided on the opening of the inside storage section 11*a* of the starter case 1 to cover the cam plate 18. The dust cover 15 is formed into a donut shape. The dust cover 15 includes a central hole 20 formed in the central portion thereof, concentric circular uneven portions 16 in the periphery of the hole 20, and an engaging step portion 17 in the outer peripheral edge thereof. The circular uneven portions 16 are formed to be similar to the circular uneven portions 13.

To mount the dust cover 15, similarly to the previously-mentioned embodiment, the central hole 20 of the dust cover 15 is fitted with the outside of the circular storage portion 22 of the cam plate 18, the concentric circular uneven portions 16 are fitted into the circular uneven portions 13 of the cam plate 18, and the engaging step portion 17 is engaged with the end of the extension portion 12 of the inside storage section 11*a* and then fixed thereto using a screw with a given clearance. In this manner, the rope reel 3, the cam plate 18 and the recoil spring 9 are accommodated into the storage portion 11.

In the above structure as well, dust produced during operation must pass through a clearance between the circular uneven portions 16, 13 which exists between the inner surface of the dust cover 15 and the side surface of the rope reel 3. Since the clearance between the circular uneven portions 16, 13 has the zigzag arrangement along the radial direction, it corresponds to an imaginarily very long straight line. Therefore, in order for dust having entered from the central hole 20 of the dust cover 15 to reach the outer edge of the rope reel 3 through the clearance between the circular uneven portions 13 and 16, the dust must go beyond the uneven portions for a long distance, which takes a lot of time. This can effectively prevent dust from entering inside the starter case 1 and sticking to the recoil rope 2 and recoil spring 9. Therefore, the poor operation or malfunction of the recoil starter due to the sticking of dust to these parts can be surely prevented.

Figure 4:
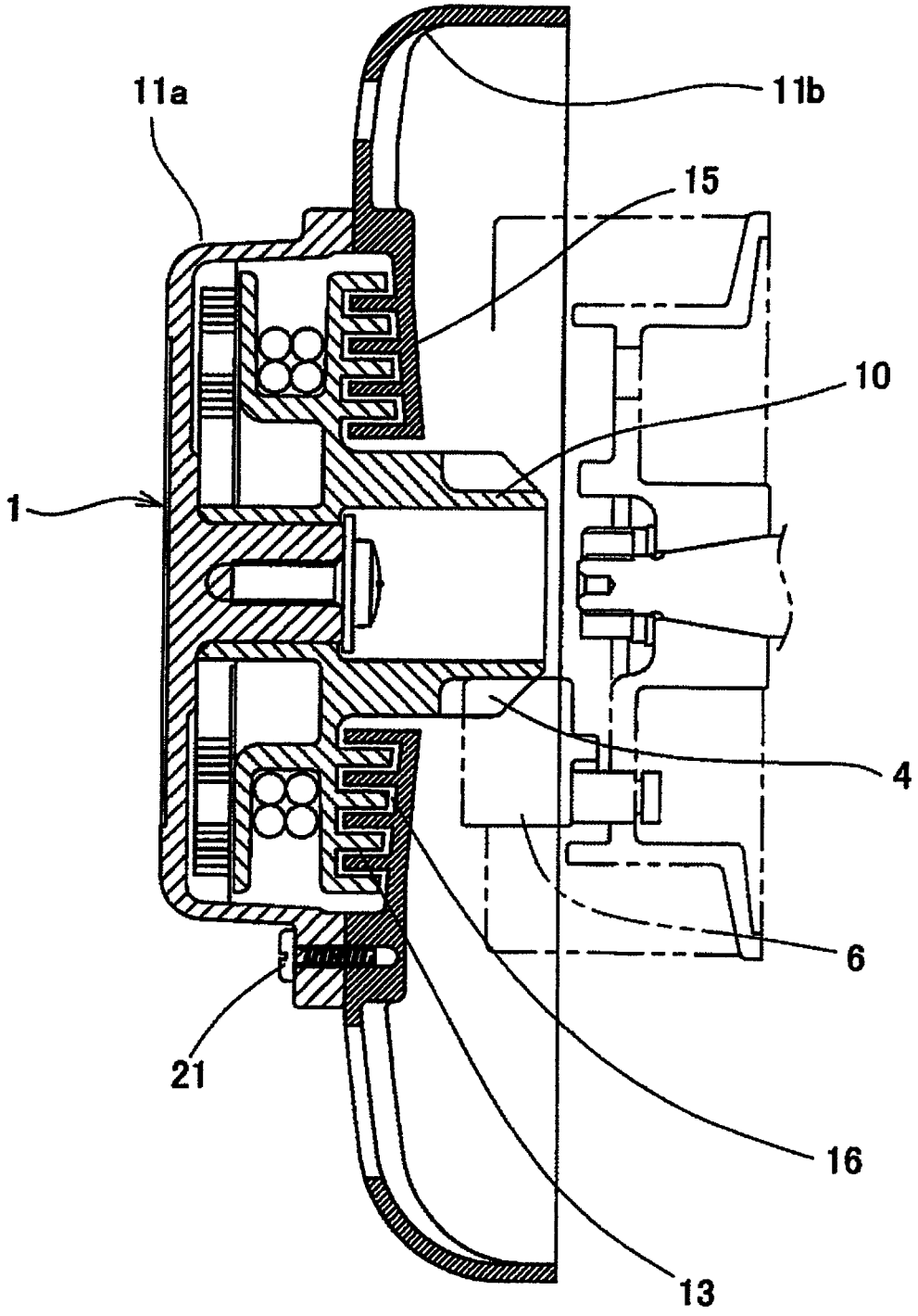
FIG. 4 cross-sectionally illustrates a recoil starter according to still another embodiment.

For example, as shown in FIG. 4, the inside storage section 11*a* and the outside storage section 11*b* of the starter case 11 may be structured as separate members. In this embodiment, the outside storage section 11*b* is integrally connected to a dust cover, and the outside storage section 11*b* is connected to the inside storage section 11*a* using a screw 21 to thereby constitute the starter case 1. Further, concentric circular uneven portions 16 and concentric circular uneven portions 13 are respectively formed in the side surfaces of the dust cover 15 and the rope reel 3 to provide a nest structure. Since the outside storage section 11*b* and the dust cover 15 are formed as an integral body, when assembling the recoil spring 9, the rope reel 3 and the like to the inside storage section 11*a*, the outside storage section 11*b* does not interrupt the assembling operation and thus the operation is facilitated.

Also in this embodiment, as shown in FIG. 3, the rope reel 3 and the cam plate 18 including the cam portion 4 may be formed as separate members, and the concentric circular uneven portions 16, 13 may be formed in the dust cover 15 and the cam plate 18 to provide a nest structure.

According to the above structure as well, it is possible to effectively prevent dust produced during operation from entering inside the starter case 1 and sticking to the recoil rope 2 and recoil spring 9. Therefore, the poor operation or malfunction of the recoil starter due to the sticking of dust to these parts can be surely prevented.

Therefore, the embodiments can provide a recoil starter which has excellent dust tightness and is stable in operation.

The invention claimed is:

1. A recoil starter for starting an engine, comprising:

a starter case including a reel support shat;

a rope reel supported for rotation on the reel support shaft and coupled with the engine;

a recoil rope wound on the rope reel;

a recoil spring acting between the rope reel and the starter case;

plural first circular uneven portions positioned on an engine side of the rope reel and facing an engine side of the recoil starter; and a dust cover secured to the starter case, the dust cover including plural second circular uneven portions engaging the first circular uneven portions in a nested configuration.

2. The recoil starter of claim 1, wherein the plural first circular uneven portions are formed on an engine side of the rope reel.

3. The recoil starter of claim 1, further comprising a cam plate coupled with the rope reel, wherein the rope reel is coupled with the engine by way of the cam plate, and wherein the plural first circular uneven portions are formed on the cam plate.

* * * * *